United States Patent [19]

Czauderna et al.

[11] 4,289,676

[45] Sep. 15, 1981

[54] BINDERS, IMPREGNATING AGENTS AND COATING AGENTS BASED ON AN AQUEOUS DISPERSION OF AN AMIDE-CONTAINING COPOLYMER

[75] Inventors: Bernhard Czauderna, Hirschberg; Andreas Einwiller, Mannheim; Kaspar Bott, Wachenheim, all of Fed. Rep. of Germany

[73] Assignee: BASF Aktiengesellschaft, Ludwigshafen, Fed. Rep. of Germany

[21] Appl. No.: 145,695

[22] Filed: May 1, 1980

[51] Int. Cl.[3] ..... C08L 33/24

[52] U.S. Cl. ..... 260/29.6 H

[58] Field of Search ..... 260/29.6 H, 29.6 HN, 260/29.7 H; 526/304

[56] References Cited

U.S. PATENT DOCUMENTS 3,137,589 6/1964 Reinhard ..... 117/140

3,422,139 1/1969 Talet ..... 526/304

FOREIGN PATENT DOCUMENTS 1103916 2/1968 United Kingdom .

*Primary Examiner*—Paul R. Michl

*Attorney, Agent, or Firm*—Oblon, Fisher, Spivak, McClelland & Maier

[57] ABSTRACT

Binders, impregnating agents and coating agents based on an aqueous dispersion of an amide-containing copolymer, wherein the copolymer contains recurring units of the general formula I

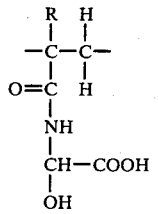

where R is H and/or $CH_3$, eliminate virtually no formaldehyde in use and may advantageously be used as binders for bonding nonwovens.

8 Claims, No Drawings

BINDERS, IMPREGNATING AGENTS AND COATING AGENTS BASED ON AN AQUEOUS DISPERSION OF AN AMIDE-CONTAINING COPOLYMER

The present invention relates to binders, impregnating agents and coating agents based on aqueous dispersions of amide-containing copolymers, which give crosslinkable films, impregnations and coatings.

Especially in the field of manufacture of bonded nonwovens from natural and/or synthetic, organic or inorganic, fibers, but also in the production of pigment prints, and in textile impregnation and textile coating, there is increasing use of binders, impregnating agents and coating agents based on aqueous dispersions of copolymers which, after drying, with or without subsequent heat treatment, crosslink and then are substantially resistant to conventional methods of drycleaning and of washing. For example, bonded nonwovens are required neither to lose their bulk nor to harden, nor to become flabby and soft, when drycleaned or washed. Discolorations must not occur in, for example, impregnations or coatings, or in bonded nonwovens. The conventional binders, impregnating agents and coating agents based on aqueous amide-containing copolymers often contain, as the principal monomers, ie. as the monomers present in amounts of 80 percent or more, mixtures of butadiene and styrene or butadiene and acrylonitrile, and also very frequently esters of acrylic acid and/or methacrylic acid with alkanols of 1 to 8 carbon atoms and/or vinyl esters, eg. vinyl acetate, and/or vinyl chloride, with or without acrylonitrile and butadiene, as copolymerized units. The amide-containing monomers present as copolymerized units in such copolymers are, in general, the N-methylolamides of acrylic acid and/or methacrylic acid, and/or their ethers, in most cases derived from alkanols of 1 to 4 carbon atoms. The amount of such amide-containing monomers is in practice mostly from 3 to 6% by weight. In addition, the copolymers in most cases contain, as copolymerized units, $\alpha,\beta$-monoolefinically unsaturated monocarboxylic acids containing 3 to 5 carbon atoms and/or dicarboxylic acids containing 4 or 5 carbon atoms or their amides. Examples of such binders are disclosed in U.S. Pat. No. 3,137,589.

These conventional binders, impregnating agents and coating agents form—after evaporation of the water—films, coatings or impregnations, and bonds between the fibers of nonwovens, which on heating, in general at from 120° to 200° C., mostly from 130° to 160° C., crosslink, resulting in excellent solvent resistance and wash resistance. This is also true if such binders are employed in pigment print pastes. However, on heating nonwovens which have been bonded with such binders, or on heating coatings and impregnations produced from such materials, substantial amounts of formaldehyde are, in general, eliminated, which can constitute a nuisance to those concerned with the production of the particular goods. Even when using bonded nonwovens at room temperature, formaldehyde is frequently eliminated and can lead to skin irritation. There has therefore been a need, for a considerable time, for binders, impregnating agents and coating agents which, whilst also giving wash-resistant and drycleaning-resistant products, eliminate very much less formaldehyde, if any, during processing and during use of the finished article.

We have found that the object of meeting this need is achieved by binders, impregnating agents and coating agents as claimed in claim 1. These products preferably contain copolymers which possess from 3 to 10% by weight of units of the general formula

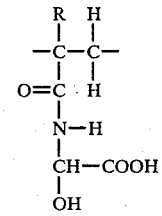

I

The copolymers present in the binders, impregnating agents and coating agents contain, to the extent of at least 85% of their weight, ie. as principal monomers, (a) a mixture of from 40 to 60 parts by weight of styrene and/or acrylonitrile and from 60 to 40 parts by weight of butadiene or (b) esters of acrylic acid and/or methacrylic acid with alkanols of 1 to 8 carbon atoms, and/or vinyl esters of acetic acid or propionic acid and/or vinyl chloride, with or without up to 40% by weight, based on total monomers (b), of acrylonitrile, styrene or butadiene, and, additionally to the monomers (a) or (b), from 0 to 5% by weight of $\alpha,\beta$-monoolefinically unsaturated monocarboxylic acids and/or dicarboxylic acids of 3 to 5 carbon atoms of the above-mentioned kind and/or their amides, all the above monomers being present as copolymerized units. The copolymers may be prepared in a conventional manner by emulsion polymerization of the monomers. They are present, in the binders, impregnating agents and coating agents, in the form of an aqueous dispersion which in general contains from 30 to 65, preferably from 40 to 55, % by weight—based on the binder, impregnating agent or coating agent—of such copolymers. The recurring units of the general formula I contained in the copolymers are derived from N-acrylamidoglycolic acid and/or N-methacrylamidoglycolic acid, and these compounds are employed in the preparation of the aqueous copolymer dispersion by emulsion polymerization, in amounts which are in general from 3 to 10% by weight, preferably from 3 to 6% by weight, based on total monomers. Acrylamidoglycolic acid and methacrylamidoglycolic acid and a process for their preparation are known from British Pat. No. 1,103,916. (This patent also discloses the emulsion copolymerization of these monomers and the use of the copolymers to produce films of reduced swellability in trichloroethylene).

The recurring units of the general formula I in the amide-containing copolymers can also advantageously be introduced by reacting emulsion copolymers which contain, as copolymerized units, the principal monomers referred to above, in the amounts stated there, and which in general contain from 1.5 to 6% by weight of acrylamide and/or methacrylamide as copolymerized units, with glyoxylic acid in, for example, an equivalent or excess amount, based on the copolymerized acrylamide or methacrylamide (though a less than equivalent amount of glyoxylic acid may also be used). Further, the amide-containing copolymers in which there are recurring units of the general formula I can be prepared by polymerizing the monomer mixture, containing acrylamide or methacrylamide, in aqueous emulsion in the presence of glyoxylic acid, under otherwise conventional conditions.

The amide-containing copolymers present in the binders, impregnating agents and coating agents according to the invention may, in addition to the monomers referred to above, contain from 0 to 5, preferably from 0 to 3, and more preferably from 0.5 to 1, % by weight of N-methylolamides of $\alpha$ ,$\beta$-monoolefinically unsaturated monocarboxylic acids and/or dicarboxylic acids of the abovementioned kind containing 3 to 5 carbon atoms, or their alkylethers, where alkyl is of 1 to 4 carbon atoms, as copolymerized units, in which case it is advantageous if the copolymers contain from 3 to 6% by weight of units of the general formula I. Particularly advantageous crosslinking is observed in the case of binders, impregnating agents and coating agents in which the amide-containing copolymers contain N-methylolacrylamide units and/or N-methylolmethacrylamide units in addition to units of the general formula I, since this results in a synergistic effect which, where the compounds are used as the sole binders for nonwovens, results in particularly high wash resistance and drycleaning resistance.

Particularly suitable acrylic acid or methacrylic acid esters of alkanols of 1 to 8 carbon atoms, to be used in the preparation of the copolymers, are ethyl acrylate, ethyl methacrylate, n-butyl acrylate, n-butyl methacrylate, isobutyl acrylate, isobutyl methacrylate, 2-ethylhexyl acrylate, 2-ethylhexyl methacrylate and also methyl acrylate, and, in amounts of up to 10% by weight based on the total of the monomers (b), methyl methacrylate, tert.-butyl acrylate and tert.-butyl methacrylate. The aqueous dispersions of the amide-containing copolymers can be prepared in a conventional manner by emulsion polymerization, using the conventional free radical polymerization initiators, emulsifiers and dispersants, with or without regulators. Most anionic and/or nonionic emulsifiers are in general employed for this purpose in an amount of from 0.1 to 10, preferably from 1 to 5, % by weight, based on the monomers. Examples of anionic emulsifiers are fatty acids of 6 to 18 carbon atoms, resin acids, fatty alcohol sulfates of 4 to 18 carbon atoms, alkylsulfonates of 10 to 18 carbon atoms, alkylarylsulfonates of 10 to 18 carbon atoms, hydroxylalkylsulfonates of 4 to 18 carbon atoms, alkali metal salts and ammonium salts of sulfosuccinic acid esters, and sulfonated adducts of ethylene oxide with fatty alcohols, fatty amides, fatty acids or alkylphenols. The choice of emulsifier is not a critical factor in the properties of the novel products, or in the preparation of the dispersions; the conventional emulsifiers, in the conventional amounts, may be employed. Examples of nonionic emulsifiers are adducts of ethylene oxide with fatty alcohols, eg. lauryl, myristyl, cetyl, stearyl and oleyl alcohol, with fatty acids, eg. lauric, myristic, palmitic, stearic and oleic acid, with their amides, and with alkylphenols, eg. isooctylphenol, isononylphenol and dodecylphenol. Further examples are reaction products of ethylene oxide with isononylmercaptan, dodecylmercaptan, tetradecylmercaptan and higher alkylmercaptans or higher alkylthiophenols, and corresponding reaction products with etherified or esterified polyhydroxy compounds having a relatively long alkyl chain, eg. sorbitol monostearate. The above oxyalkylation products in general contain from 5 to 80 moles of ethylene oxide units; oxyalkylation products of the above type, which contain propylene oxide in addition to ethylene oxide, may also be used.

Examples of suitable initiators are inorganic peroxy compounds, eg. hydrogen peroxide, sodium, potassium or ammonium peroxydisulfates, peroxycarbonates and borate peroxy hydrates, as well as organic peroxy compounds, eg. acyl hydroperoxides, diacyl peroxides, alkyl hydroperoxides, dialkyl peroxides and esters, eg. tert.-butyl perbenzoate. The amount of initiator used is in general from 0.01 to 5% by weight, based on total monomers. The above peroxy compounds can also be employed as redox catalysts in combination with reducing agents. Examples of suitable reducing agents are alkali metal disulfites, alkali metal bisulfites, ammonium bisulfite, thiosulfates, dithionites and formaldehyde-sulfoxylates, as well as iron-II sulfate, titanium-III sulfate, glucose and ascorbic acid. Where redox catalysts are employed, the presence of promoters is often an advantage. For example, traces of metal salts, especially of copper, manganese, iron, cobalt and/or nickel salts, may be used as promoters.

Examples of suitable regulators are carbon tetrachloride, trichlorobromomethane, tetrachloroethane, methallyl chloride, alcohols, eg. isopropanol and dodecanol, alkylmercaptans and dialkyl xanthates, eg. diisopropyl xanthate disulfide. The emulsion polymerization is in general carried out at from 10° to 95° C., preferably from 40° to 90° C., at a pH which is in general from 1 to 9. The dispersions obtained in general contain from 30 to 60% by weight of copolymer.

In the process of preparation of the aqueous dispersions of the amide-containing copolymers which possess units of the general formula I the emulsion copolymerization (which, for example, employs a monomer feed process or the emulsion feed process) may, instead of being carried out with N-acrylamidoglycolic acid or N-methacryloamidoglycolic acid, be carried out with a sufficient amount of acrylamide or methacrylamide, ie. in general with from 1.5 to 6, preferably from 1.5 to 3.5, % by weight of these compounds, based on total monomers, with a stoichiometric amount—based on acrylamide or methacrylamide—of glyoxylic acid being present, from the start, in the aqueous phase; alternatively, the glyoxylic acid may be added in accordance with the rate of addition of the monomers, either as a mixture with the monomers or separately, or may be added progressively to the polymerization mixture in accordance with the rate at which the polymerization progresses. In this case, i.e. in all the cases in which glyoxylic acid is added, it is preferred to use the persulfates of the above type as polymerization initiators and to work at from 60° to 85° C., especially from 70° to 85° C.

In addition to containing the aqueous dispersions of the amide-containing copolymers, which possess recurring units of the general formula I, the novel binders, impregnating agents and coating agents may also contain conventional additives, for example pigments, antioxidants, dyes, plasticizers and film-forming assistants, in the conventional amounts. They may be used particularly advantageously as binders for nonwovens consisting of the conventional natural and synthetic fibers, for example of cotton, wool, polyethylene glycol terephthalate, nylons and/or polyolefins, as well as rock wool, asbestos fibers and the like. They may also be used as impregnating agents for woven and nonwoven sheet-like textiles, as binders in textile print pastes and paper-coating compositions, and as coating agents for films, sheet-like textiles and metallic articles.

Where the novel products are used as binders for nonwovens, these may also be doubled, filament-reinforced, needle-punched, calendered and/or preshrunk before application of the binders. The binders may be applied to the nonwovens by conventional methods, ie. impregnation, foam impregnation, spraying, slop-padding or printing. After the nonwovens have been treated with the novel binders and the excess binder has been removed, for example by squeezing off, the impregnated nonwoven is in general dried and then heated. Drying may be carried out, for example, for from 1 to 10 minutes at from 100° to 170° C., and heating for from 0.5 to 3 minutes at from 110° to 200° C. In general, the binder is employed in an amount such that the content of copolymer in the bonded nonwoven is from 15 to 60% by weight, based on fibrous material.

In the Examples which follow, parts and percentages are by weight.

(A) PREPARATION EXAMPLES

EXAMPLE 1

An emulsion of 566 parts of ethyl acrylate, 5.5 parts of N-methylolacrylamide, 27 parts of N-methacrylamidoglycolic acid and 6 parts of sodium dodecylsulfate in 382 parts of water, and 50 parts of a 4% strength potassium peroxydisulfate solution, are added progressively, over 2 hours, to a stirred solution of 0.3 part of potassium peroxydisulfate in 389 parts of water at 85° C. Thereafter, 25 parts of a 4% strength potassium peroxydisulfate solution are added over 1 hour at the same temperature, and stirring is then continued for 2 hours, again at 85° C. After the mixture has cooled to 40° C., 0.4 part of cumene hydroperoxide and 0.4 part of sodium formaldehyde-sulfoxylate are added and the mixture is stirred for 1 hour at 40° C. This gives an aqueous dispersion of an amide-containing copolymer, the copolymer containing 4.5% by weight of recurring units of the general formula I. The dispersion may be employed, as obtained, as a binder for nonwovens, as an impregnating agent for textiles and as a binder for pigment print pastes.

EXAMPLE 2

A solution of 1,126 parts of ethyl acrylate and 26 parts of acrylamide, a solution of 34 parts of glyoxylic acid monohydrate, 26 parts of N-methylolmethacrylamide, 12 parts of sodium dodecyl-sulfate and 200 parts of water, and 100 parts of an activator solution containing 2.4 parts of ascorbic acid and 0.012 part of iron-II sulfate in 97.6 parts of water, are added, over 2 hours, to a stirred solution of 8 parts of 30% strength aqueous hydrogen peroxide, 0.24 part of ascorbic acid and 0.0012 part of iron-III sulfate in 602 parts of water, at 40° C. A further 20 parts of the activator solution of the above composition are then added at the same temperature over a further hour. After cooling, an aqueous dispersion of an amide-containing copolymer, the copolymer containing 4.5% by weight of units of the general formula I, is obtained; this dispersion may be used, as obtained, as a binder for nonwovens, and for the production of unpigmented or pigmented coatings on textile webs.

EXAMPLE 3

An emulsion of 284 parts of ethyl acrylate, 284 parts of n-butyl acrylate, 23 parts of N-methylolmethacrylamide (in the form of a 45% strength aqueous solution), 13 parts of acrylamide and 6 parts of sodium dodecylsulfate in 401 parts of water, and 50 parts of an aqueous activator solution comprising 1.2 parts of ascorbic acid and 0.0006 part of iron-II sulfate in 48.8 parts of water, are added, over 2 hours, to a mixture of 4 parts of 30% strength aqueous hydrogen peroxide, 0.12 part of ascorbic acid and 0.0006 part of iron-II sulfate in 425 parts of water at 45° C. Thereafter, a further 10 parts of the activator solution of the above composition are added, at the same temperature, over a further hour. When the mixture has cooled, 17 parts of glyoxylic acid monohydrate are added. An aqueous dispersion of an amide-containing copolymer, the copolymer containing 4.4% by weight of units of the general formula I, is obtained. The dispersion may be employed as obtained, or after admixture of conventional additives, as a binder for nonwovens, for example in the production of nonwovens suitable for use as interlinings.

EXAMPLE 4

The procedure described in Example 1 is employed, but the only monomers employed are 566 g of ethyl acrylate and 27 g of N-acrylamidoglycolic acid, the other conditions being identical. The resulting aqueous dispersions may be employed, as obtained, as a binder for nonwovens.

(B) EXAMPLES OF THE USE OF THE DISPERSIONS, PREPARED AS DESCRIBED IN EXAMPLES 1 TO 4, AS BINDERS FOR NONWOVENS.

EXAMPLE 5

A cross-laid nonwoven (weighing 40 g/m$^2$), consisting of 65 parts of nylon staple fibers (3.3dtex/60 mm staple length) and 35 parts of polyester staple fibers (1.7dtex/40 mm staple length) is impregnated, by the immersion method, with one of the binders of Example 1–4. The solids content of the liquors is 15%.

In each case, 1% of maleic acid (the percentage being calculated as solid maleic acid, based on resin solids) is added, as the crosslinking catalyst, to the binder mixture. The substrates are squeezed off after impregnation and then dried, accompanied by condensation, for 6 minutes at 150° C. The squeeze-off pressure of the padder is set to give a fiber/binder ratio of 2:1 after drying.

The finished nonwovens are subjected to a drycleaning test in perchloroethylene (in accordance with DIN 54,303, part 1). Evaluation of the results leads to the following conclusions:

The substrates bonded with polymers 1, 2 and 3 withstand the drycleaning process without detactable surface damage. The nonwoven bonded with binder 4 shows only slight fluffing.

EXAMPLE 6

A nonwoven consisting of 100% nylon fibers (3.3dtex/40 mm staple length) and weighing 45 g/m$^2$ is impregnated with the binders of Examples 1–4 (the mixtures used being as in Example 5; the excess binder is squeezed off between 2 rolls and the impregnated substrate is dried, accompanied by condensation, for 6 minutes at 140° C. The fiber/binder ratio is 2:1 in each case. The results of a tensile test on a strip (DIN 53,857, sheet 2) are shown in Table 1 below.

TABLE 1

| Tensile test on strips | (daN/5 cm strips) | | | |
|---|---|---|---|---|
| Polymer | 1 | 2 | 3 | 4 |
| Maximum tensile force ($F_H$), dry | 800daN | 710daN | 750daN | 970daN |

TABLE 1-continued

| Tensile test on strips | (daN/5 cm strips) | | | |
|---|---|---|---|---|
| Polymer | 1 | 2 | 3 | 4 |
| Maximum tensile force ($F_{Hw}$), wetted with water | 600daN | 520daN | 500daN | 550daN |

A cross-laid carded web, consisting of 100% viscose fibers (1.7dtex/40 mm staple length) and weighing 50 g/m$^2$ is bonded with polymer dispersions 1–4 in the same way as in Examples 5 and 6. The results of the tensile test on strips of the nonwovens, in which the fiber/binder ratio is 7:3, are shown in Table 2 below.

TABLE 2

| Tensile test on strips | (daN/5 cm strips) | | | |
|---|---|---|---|---|
| Polymer | 1 | 2 | 3 | 4 |
| Maximum tensile force ($F_H$), dry | 840daN | 900daN | 880daN | 850daN |
| Maximum tensile force ($F_{Hw}$), wetted with water | 370daN | 310daN | 320daN | 390daN |
| Maximum tensile force ($F_{HL}$), wetted with perchloroethylene | 440daN | 490daN | 390daN | 220daN |

(C) COMPARATIVE EXPERIMENTS

Comparative dispersion I

A mixture of 566 parts of ethyl acrylate, 13 parts of N-methylolmethacrylamide (as a 40% strength aqueous solution) and 13 parts of acrylic acid is polymerized by the method described in Example 1.

Comparative dispersion II

A monomer mixture of 566 parts of ethyl acrylate and 45.5 parts of N-methylolmethacrylamide (in the form of a 45% strength aqueous solution) is polymerized by the method described in Example 1.

The comparative dispersions I and II are tested under the same conditions as in Examples 5 to 7, and the following results are obtained:

In the drycleaning test (Example 5), the substrate bonded with dispersion II withstands the test without discernible surface damage, whilst the web bonded with dispersion I disintegrates completely.

In the tensile test on strips (Example 6), using a nylon nonwoven, the maximum tensile force ($F_H$) for dry material is found to be 700daN for dispersion I and 710daN for dispersion II, whilst the maximum tensile force ($F_{Hw}$) for material wetted with water is found to be 190daN for dispersion I and 260daN for dispersion II.

In a tensile test on strips (Example 7), carried out on a viscose nonwoven, the values shown in Table 3 are obtained for dispersions I and II:

TABLE 3

| Tensile test on strips (daN/5 cm strips) Dispersion | I | II |
|---|---|---|
| Maximum tensile force ($F_H$), dry | 780daN | 800daN |
| Maximum tensile force ($F_{Hw}$), wetted with water | 170daN | 320daN |

TABLE 3-continued

| Tensile test on strips (daN/5 cm strips) Dispersion | I | II |
|---|---|---|
| Maximum tensile force ($F_{HL}$), wetted with perchloroethylene | 120daN | 450daN |

We claim:

1. A binder, impregnating agent and coating agent based on an aqueous dispersion of an amide-containing copolymer which contains from 3 to 6% by weight of recurring units of formula I:

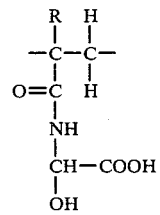

when R is H and/or $CH_3$, up to 3% by weight of units of formula II:

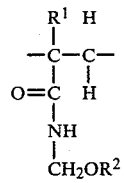

when $R^1$ is H or $CH_3$ and $R^2$ is H or alkyl of 1 to 4 carbon atoms, and not less than 85% by weight of (a) a mixture of from 40 to 60 parts by weight of styrene and/or acrylonitrile and from 60 to 40 parts by weight of butadiene or (b) vinyl monomers selected from the group consisting of esters of acrylic acid or methacrylic acid with alkanols of 1 to 8 carbon atoms, vinyl esters and vinyl chloride, together with up to 40% by weight, based on total monomers (b), of acrylonitrile, styrene or butadiene, and from 0 to 5% by weight of $\alpha,\beta$-monoolefinically unsaturated monocarboxylic acids and/or dicarboxylic acids of 3 to 5 carbon atoms and/or their amides, the said monomers being present as copolymerized units.

2. The binder, impregnating agent and coating agent of claim 1, wherein said vinyl ester is an ester of a carboxylic acid selected from the group consisting of acetic acid and propionic acid.

3. The binder, impregnating agent and coating agent of claim 1, wherein said aqueous dispersion contains 30–65% by weight of the amide-containing copolymer.

4. The binder, impregnating agent and coating agent of claim 1, wherein said aqueous dispersion contains 40–55% by weight of the amide-containing copolymer.

5. The binder, impregnating agent and coating agent of claim 1, wherein said amides of $\alpha,\beta$-monoolefinically unsaturated monocarboxylic acids and/or dicarboxylic acids of 3 to 5 carbon atoms are N-methylolamides.

6. The binder, impregnating agent and coating agent of claim 1, wherein said amides of $\alpha,\beta$-monoolefinically unsaturated monocarboxylic acids and/or dicarboxylic acids of 3 to 5 carbon atoms are alkyl ethers of N-methylolamides wherein said alkyl groups contain 1 to 4 carbon atoms.

7. The binder, impregnating agent and coating agent of claim 1, wherein said amide-containing copolymer contains 0.5 to 1% by weight of said $\alpha,\beta$-monoolefinically unsaturated monocarboxylic acid and/or dicarboxylic acid and/or their amides.

8. The binder, impregnating agent and coating agent of claim 1, wherein said ester of acrylic acid or methacrylic acid is selected from the group consisting of ethyl acrylate, ethyl methacrylate, n-butyl acrylate, n-butyl methacrylate, isobutyl acrylate, isobutyl methacrylate, 2-ethylhexyl acrylate, 2-ethylhexyl methacrylate and methyl acrylate, and up to 10% by weight based on the total monomers of (b) of esters selected from the group consisting of methyl methacrylate, t-butyl acrylate and t-butyl methacrylate.

* * * * *

UNITED STATES PATENT AND TRADEMARK OFFICE

CERTIFICATE OF CORRECTION

PATENT NO. : 4,289,676

DATED : Sep. 15, 1981

INVENTOR(S) : BERNHARD CZAUDERNA ET AL

It is certified that error appears in the above-identified patent and that said Letters Patent are hereby corrected as shown below:

Please insert the following Priority Data:

[30]--Foreign Application Priority Data

May 19, 1979 [DE] Fed. Rep. of Germany.....2920377

Signed and Sealed this

*Fifteenth* Day of *December 1981*

[SEAL]

*Attest:*

GERALD J. MOSSINGHOFF

*Attesting Officer*

*Commissioner of Patents and Trademarks*